US005890481A

United States Patent [19]

Bigelow

[11] Patent Number: 5,890,481

[45] Date of Patent: Apr. 6, 1999

[54] METHOD AND APPARATUS FOR CUTTING DIAMOND

[75] Inventor: Louis Kimball Bigelow, Boylston, Mass.

[73] Assignee: Saint-Gobain/Norton Industrial Ceramics Corporation, Worcester, Mass.

[21] Appl. No.: 627,814

[22] Filed: Apr. 1, 1996

[51] Int. Cl.[6] ..... B28D 1/00

[52] U.S. Cl. ..... 125/16.02; 125/16.01; 125/21

[58] Field of Search ..... 125/16.01, 16.02, 125/21; 30/116, 140; 83/651.1

[56] References Cited

U.S. PATENT DOCUMENTS

| | | | |
|---|---|---|---|
| 3,954,096 | 5/1976 | Barta et al. | 125/1 |
| 5,269,283 | 12/1993 | Toyama et al. | 125/21 |
| 5,519,938 | 5/1996 | Kojima et al. | 125/21 |

FOREIGN PATENT DOCUMENTS 62-41800 2/1987 Japan .

OTHER PUBLICATIONS

S. Jin, et al., "Massive Thining Of Diamond Films By A Diffusion Process", Appl. Physics Letters, vol. 60, No. 16, Apr. 20, 1992.

S. Jin, et al., "Polishing Of CVD Diamond By Diffusional Reaction With Manganese Powder", Journal of Diamond and Related Materials, vol. 1, No. 9, Netherlands, Sep. 25, 1992.

Masanori Yoshikawa, "Development And Performance Of A Diamond Film Polishing Apparatus With Hot Metals", SPIE vol. 1325 Diamond Optics III, pp. 210–221, Japan, 1990.

*Primary Examiner*—Eileen Morgan

*Attorney, Agent, or Firm*—Volker R. Ulbrich; Martin M. Novack

[57] ABSTRACT

A wire is used to cut or slice diamond by passing the wire rapidly and under light load over and into the diamond surface along a line to be cut. In one form of the invention, the wire comprises a metal that dissolves diamond, such as iron or nickel and the wire and/or diamond is preferably heated to approach the metal-carbon eutectic temperature and create sensible reaction rates of the carbon on the wire surface. In another form of the invention, the moving wire carries a molten oxidant to enhance the cutting rate. The molten oxidant may be, for example, sodium nitrate, which oxidizes carbon.

29 Claims, 2 Drawing Sheets

METHOD AND APPARATUS FOR CUTTING DIAMOND

FIELD OF THE INVENTION

This invention relates to the field of cutting hard materials and, more particularly, to the cutting of diamond.

BACKGROUND OF THE INVENTION

Diamond is an extraordinary material which has, among other characteristics, superlative hardness, thermal conductivity, and optical transmissivity. It is also an excellent electrical insulator and chemically inert in most environments. In recent years, techniques have been devised for fabricating relatively large pieces of synthetic diamond, such as by chemical vapor deposition ("CVD") methods. When, for example, a relatively large wafer of synthetic diamond is made, it may be desirable to cut or dice the wafer into smaller pieces for uses such as optical windows, electronic substrates, or heat sinks. Since diamond is the hardest known material, it is very difficult to cut. Cutting with another diamond medium can be a slow and expensive process. Wire electro discharge machining ("wire EDM") is not suitable for cutting high quality diamond, because the electrical conductivity is too low. Laser cutting can be employed for some applications, but the focused laser beam typically used for cutting has a conical shape that is of limited utility for cutting materials of substantial thickness, since the cut becomes relatively wide and tends to consume too much diamond.

The general inertness of diamond renders chemically based cutting difficult. Use of a wheel made from a metal that reacts with diamond has had limited success.

It is among the objects of the present invention to provide a technique and apparatus for cutting diamond, and to overcome limitations of prior art techniques.

SUMMARY OF THE INVENTION

In embodiments of the present invention, a wire is used to cut or slice diamond by passing the wire rapidly and under light load over and into the diamond surface along a line to be cut.

In one form of the invention, the wire comprises a metal that reacts with and/or dissolves diamond, such as iron or nickel and the wire and/or diamond is preferably heated to approach the metal-carbon eutectic temperature and create sensible reaction rates of the carbon on the wire surface. Heating may be implemented, for example, by using a heating furnace to heat the entire cutting environment, and/or by resistive heating of the wire. The diameter of the wire (which, for wire of non-circular cross-section, means the thickness of the wire in the dimension perpendicular to the direction of cut) is preferably in the range 1 micrometer to 100 micrometers. The temperature at the cut should preferably be at least 500° C., and can approach or even exceed the metal-carbon eutectic temperature. The rate of wire movement will preferably be in the range 0.001 to 100 meters per second. Typically, the higher speeds will be possible with finer wires and higher diffusion coefficients of carbon in the metal. The wire and diamond may be protected by a reducing gas such as hydrogen, and/or a protective inert gas such as nitrogen or argon.

In another form of the invention, the moving wire carries a molten oxidant to enhance the cutting rate. The molten oxidant may be, for example, sodium nitrate, which oxidizes carbon. A longitudinal groove in the wire can be used to increase the volume of oxidant carried by the wire.

Further features and advantages of the invention will become more readily apparent from the following detailed description when taken in conjunction with the accompanying drawings.

DETAILED DESCRIPTION

Figure 1:
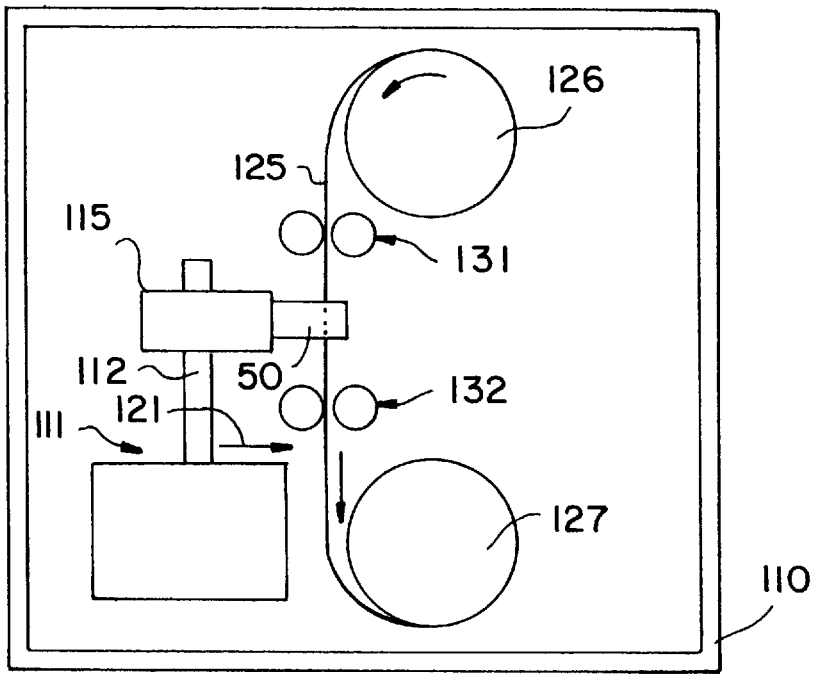
FIG. 1 is a schematic diagram of an apparatus that can be utilized in practicing an embodiment of the invention.

In the embodiment of FIG. 1, a cutting apparatus is in a suitable heated environment that can be provided, for example, by a furnace 110. In this embodiment the furnace may be heated, for example, to a temperature of about 700° C. The diamond 50 to be cut is mounted in a holder represented at 115. The wire 125 used in the cutting technique is fed from a supply spool 126 to a take-up spool 127. In some cases, the wire can be re-used, for example on a continuous loop, or by reversing direction. Re-use may also be facilitated by exposing the wire after passage past the diamond to an environment, such as hydrogen, which will remove the carbon from the wire. Guide rollers are illustrated at 131 and 132. In the embodiment of FIG. 1, the load force of the wire on the diamond can be controlled by a moveable mounting apparatus 111. In particular, a rod 112, which carries holder 115, can translate in the direction indicated by the arrow 121, for example by using a known type of servomechanism and gearing, to apply the desired load. If desired, the rod 112 can also reciprocate in a direction parallel to the wire.

Figure 2:
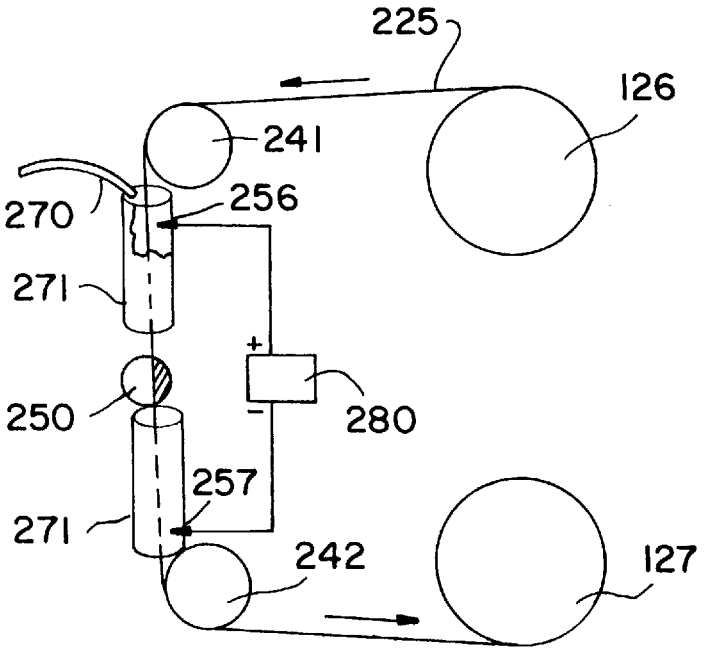
FIG. 2 is a schematic diagram of an apparatus that can be utilized in practicing another embodiment of the invention.

In the embodiment of FIG. 2, the wire 225 is again fed from supply spool 126 to take-up spool 127. Guide rollers are shown at 241 and 242. In the embodiment of FIG. 2, heating of the wire 125 is implemented using resistance heating. A source of electric potential 280 is coupled with electrodes 256 and 257. The electrodes may be, for example, wiper electrodes or brushes. In this manner, the section of wire 125 that is between the electrodes 256 and 257 is resistively heated. The diamond to be cut is represented at 250, and can be mounted, for example, as was first shown in FIG. 1, with means to apply an appropriate load. A protective gas, for example a hydrogen reducing gas or inert gas, can be used to facilitate the cutting. The gas can be contained in the deposition chamber (not shown in this Figure), or can be injected from a source (270) into an envelope or envelopes, represented at 271.

At high temperature (e.g. approaching or even exceeding the eutectic temperature), the diamond (carbon) can be envisioned as going into solid solution in the liquified or semi-liquified metal on the outer portion of the wire, and the carbon in solid solution is carried off by the moving wire. The selection of material and temperature can also take into account the diffusion of carbon into the solid solution, the diffusion rate affecting the cutting efficiency. For example, preferred wire materials hereof, iron and nickel (which can be drawn into wire of suitable size at practical cost), will result in a lower eutectic temperature of the metal-carbon solution than would other metals having higher melting temperature. However, while a higher eutectic temperature may, of itself, permit a higher temperature operation, a lower diffusion rate of carbon into the metal solid solution can greatly reduce cutting efficiency, which can more than cancel out any advantage of the higher temperature operation.

The diameter of the wire is preferably in the range 1 micrometer to 100 micrometers, and the rate of wire movement is preferably in the range 0.001 to 10 meters per second. Typically, the higher speeds will be possible with finer wires and higher diffusion coefficients of carbon in the metal. For high wire speeds it can be desirable to heat the surface region of the wire to at least the eutectic temperature, but with the center of the wire at a lower temperature to maintain the mechanical integrity of the wire.

The substance that dissolves or reacts with diamond can be carried by a wire formed of another substance. For example, in the embodiment of FIG. 1, the wire could be formed of a metal such as tungsten, and be coated with a substance such as iron or nickel to achieve the desired result. The iron or nickel could be formed on the wire or could be picked up in powered or molten form by passing the wire through a source thereof.

Figure 3:
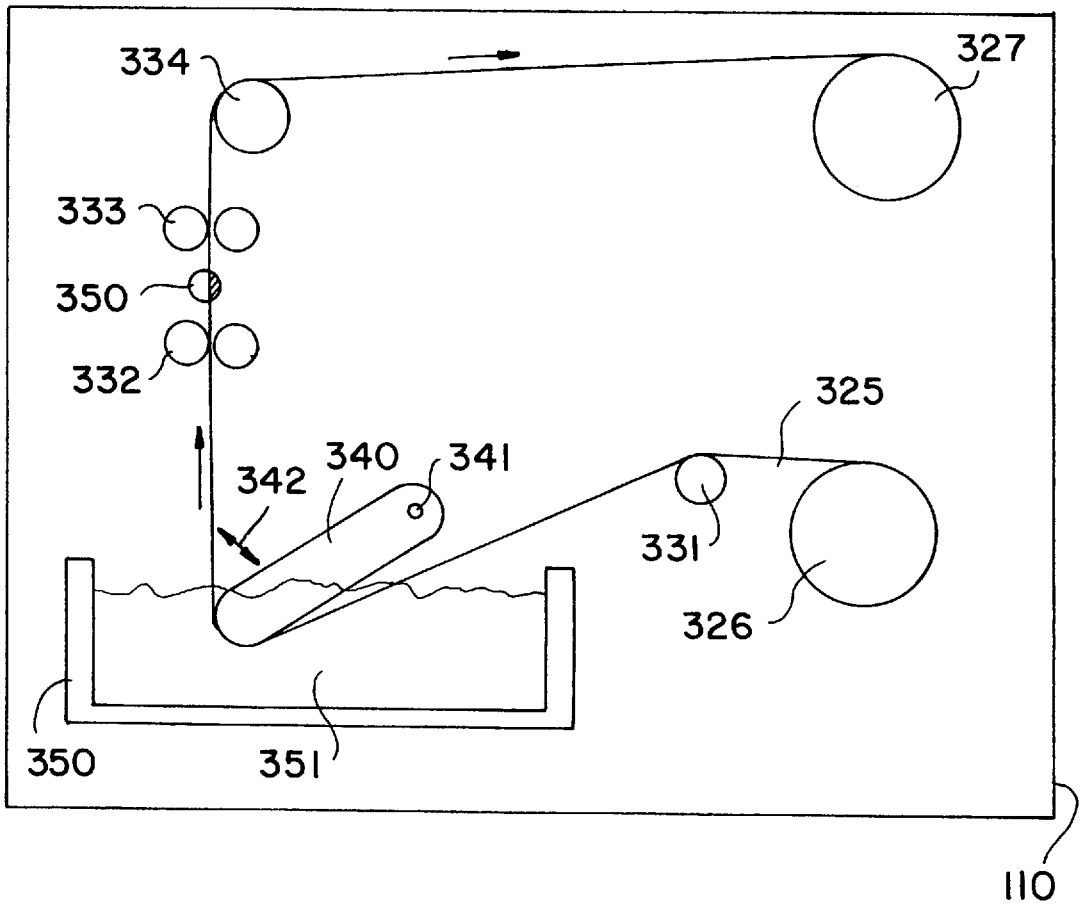
FIG. 3 is a schematic diagram of an apparatus that can be utilized in practicing still another embodiment of the invention.
Figure 4:
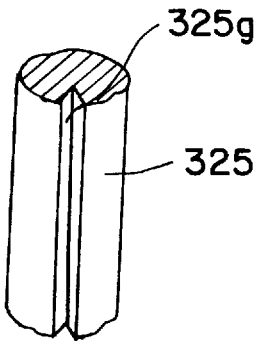
FIG. 4 shows a grooved wire that can be used in practicing an embodiment of the invention.
Figure 5:
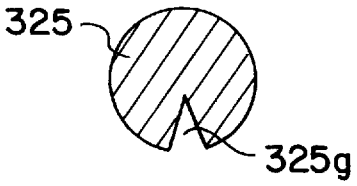
FIG. 5 shows a cross-section of the wire of FIG. 4.

In the embodiment of FIG. 3, a wire 325 is used and travels between a supply spool 326 and a take-up spool 327. Guide rollers are illustrated at 331, 332, 333, and 334, A mandrel 340 is pivotally mounted at 341, and can be operator controlled, as represented by the two-headed arrow 342, to determine the degree of excursion of the wire through a molten oxidant bath, represented in the Figure by the trough 350 which contains the oxidant 351. The diamond to be cut is represented at 350 and, again, can be mounted as first shown in FIG. 1. The oxidant material may be, for example, molten sodium nitrate, which can be heated by any suitable heating means, (not shown). Other oxidants are potassium nitrate, sodium chlorate, and potassium chlorate. The wire 325 for this embodiment should comprise a material that is resistant to the oxidizing agent, for example a high chromium stainless steel or glass. A groove can be provided in the wire to increase the volume of oxidant material carried to the cutting region. This is illustrated in the diagram of FIG. 4 which illustrates a longitudinal V-shaped groove 325*g* in a cylindrical wire 325. FIG. 5 shows the wire 325 and V-shaped groove 325g in cross-section. It will be understood that other wire shapes and other groove shapes could be employed. The embodiment of FIG. 3 can achieve a relatively high cutting rate, although some grain boundary attack may occur and result in a relatively rougher finish than would be expected for the previously described embodiments where a wire is used in dissolving carbon into solid solution.

The invention has been described with reference to particular preferred embodiments, but variations within the spirit and scope of the invention will occur to those skilled in the art. For example, it will be understood that other techniques can be utilized to provide heating in the cutting region, and that other wire materials and techniques for applying suitable load could be employed. It will also be understood that in the embodiments hereof, the wire can have various cross-sectional shapes in addition to circular, including, for example, elliptical, triangular, and rectangular.

What is claimed is:

1. A method for cutting diamond, comprising the steps of:

providing a wire formed of a substance that dissolves carbon;

heating said wire; and urging said wire and diamond together and moving said wire longitudinally.

2. The method as defined by claim 1, wherein said substance is a metal selected from the group consisting of iron and nickel.

3. The method as defined by claim 2, wherein said wire is heated to a temperature that is greater than 500° C.

4. The method as defined by claim 2, wherein the surface of said wire is heated to the eutectic temperature of carbon and the substance of said wire.

5. The method as defined by claim 2, wherein said wire diameter is in the range 1 to 100 micrometers.

6. The method as defined by claim 2, wherein the rate of wire longitudinal movement is in the range 0.001 to 100 meters per second.

7. The method as defined by claim 1, wherein said wire is heated to a temperature that is greater than 500° C.

8. The method as defined by claim 1, wherein said wire and said diamond are heated in a furnace.

9. The method as defined by claim 1, wherein said wire is heated by applying an electric potential across said wire to implement resistive heating thereof.

10. The method as defined by claim 1, wherein said wire diameter is in the range 1 to 100 micrometers.

11. The method as defined by claim 1, wherein the rate of wire longitudinal movement is in the range 0.001 to 100 meters per second.

12. The method as defined by claim 1, further comprising providing a reducing gas or an inert gas in the region where said diamond is being cut.

13. Apparatus for cutting a piece of diamond, comprising:

a wire formed of a substance that dissolves carbon;

means for moving said wire longitudinally;

means for heating said wire; and means for urging said wire and said piece of diamond together.

14. Apparatus as defined by claim 13, wherein said substance is a metal selected from the group consisting of iron and nickel.

15. Apparatus as defined by claim 13, wherein said means for moving said wire longitudinally comprises means for moving said wire at a longitudinal rate in the range 0.001 to 100 meters per second.

16. Apparatus as defined by claim 13, wherein said wire diameter is in the range 1 to 100 micrometers.

17. A method for cutting diamond, comprising the steps of:

providing a wire carrying a substance that dissolves carbon;

heating said wire; and urging said wire and diamond together and moving said wire longitudinally.

18. The method as defined by claim 17, wherein said substance is a metal selected from the group consisting of iron and nickel.

19. The method as defined by claim 17, wherein the substance carried by said wire is heated to a temperature greater than 500° C.

20. The method as defined by claim 17, wherein the substance carried by said wire is heated to the eutectic temperature of carbon and the substance carried by said wire.

21. The method as defined by claim 17, wherein the rate of wire longitudinal movement is in the range 0.001 to 100 meters per second.

22. A method for cutting diamond, comprising the steps of:

providing a wire, said wire carrying a molten oxidant that oxidizes carbon;

heating said wire; and urging said wire and diamond together and moving said wire longitudinally.

23. The method as defined by claim 22, wherein said oxidant is a compound selected from the group consisting of sodium nitrate, potassium nitrate, sodium chlorate, and potassium chlorate.

24. The method as defined by claim 23, wherein said wire has a longitudinal groove which can carry said oxidant.

25. The method as defined by claim 22, wherein said oxidant is sodium nitrate.

26. The method as defined by claim 22, wherein said wire has a longitudinal groove which can carry said oxidant.

27. The method as defined by claim 22, wherein the rate of wire longitudinal movement is in the range 0.001 to 100 meters per second.

28. Apparatus for cutting a piece of diamond, comprising:

a wire carrying a substance that dissolves carbon;

means for moving said wire longitudinally;

means for heating said wire; and means for urging said wire and said piece of diamond together.

29. Apparatus for cutting a piece of diamond, comprising: a wire;

means for moving said wire longitudinally;

means for heating said wire;

means for applying a molten oxidant to said wire; and means for urging said wire and said piece of diamond together.

* * * * *